US008360756B2

(12) United States Patent
Ford

(10) Patent No.: US 8,360,756 B2
(45) Date of Patent: Jan. 29, 2013

(54) VALVE ROD GUIDE WITH CYCLONIC DEBRIS REMOVAL

(76) Inventor: Michael Brent Ford, St. George, UT (US)

( * ) Notice: Subject to any disclaimer, the term of this patent is extended or adjusted under 35 U.S.C. 154(b) by 306 days.

(21) Appl. No.: 12/565,919

(22) Filed: Sep. 24, 2009

(65) Prior Publication Data

US 2010/0108150 A1 May 6, 2010

Related U.S. Application Data

(60) Provisional application No. 61/110,050, filed on Oct. 31, 2008.

(51) Int. Cl.
*F04B 39/00* (2006.01)
*F04B 53/00* (2006.01)

(52) U.S. Cl. ..... 417/430; 417/555.2; 166/332.2

(58) Field of Classification Search ..... 417/555.2, 417/430; 92/165 R; 166/322.1, 322.2; 137/809
See application file for complete search history.

(56) References Cited

U.S. PATENT DOCUMENTS

| | | | | | |
|---|---|---|---|---|---|
| 2,590,245 | A * | 3/1952 | Harbison | 166/105.4 |
| 2,776,172 | A * | 1/1957 | Deitrickson | 384/16 |
| 5,095,977 | A * | 3/1992 | Ford | 166/113 |
| 5,141,416 | A * | 8/1992 | Cognevich et al. | 417/554 |
| 5,494,104 | A * | 2/1996 | Sable, II | 166/241.4 |
| 5,894,053 | A * | 4/1999 | Fried | 428/548 |
| 6,283,148 | B1 * | 9/2001 | Spears et al. | 137/533.11 |
| 6,702,067 | B2 * | 3/2004 | Iversen et al. | 184/6.16 |
| 6,755,628 | B1 * | 6/2004 | Howell | 417/448 |
| 6,776,232 | B2 * | 8/2004 | Skillman | 166/241.4 |
| 6,966,248 | B2 * | 11/2005 | Mahoney | 92/13.41 |
| 7,713,035 | B2 * | 5/2010 | Ford | 417/430 |
| 2006/0083646 | A1 * | 4/2006 | Ford | 417/555.1 |
| 2008/0217565 | A1 * | 9/2008 | Ford | 251/120 |

OTHER PUBLICATIONS

Cold spray powder coatings: p. 1, p. 11-12; Eutectic Castolin. "Cold Spray Powders." Eutectic Castolin North America. Web. May 10, 2012. <http://www.eutecticusa.com/wEutectic_usa/products/coating/cold_spray.php?navid=63>.*

Eutectic Canada Inc. ProXon 21041—MSDS. Québec: Eutectic Canada, 1999.*

Eutectic Castolin. "Cold Spray Powders." Eutectic Castolin North America. Web. May 10, 2012. <http://www.eutecticusa.com/wEutectic_usa/products/coating/cold_spray.php?navid=63>.*

* cited by examiner

*Primary Examiner* — Devon Kramer
*Assistant Examiner* — Joseph Herrmann
(74) *Attorney, Agent, or Firm* — Weiss & Moy, P.C.; Jeffrey D. Moy

(57) ABSTRACT

A valve rod guide is adapted to be coupled to the barrel of a subsurface pump or the like. The guide has head, neck, body, and base regions. A plurality of angled flutes are provided on the body, tapering downwardly for preventing solids from reentering the pump barrel after pump operations are ceased and thereby damaging pump components once pump operations are resumed. The interior diameter of the neck includes lower and upper grooves and a plurality of spiral radial grooves extending therebetween. The spiral radial grooves terminate at exit ports. During pump operations, solids are wiped from the valve rod, drawn into the spiral radial grooves, and accumulate in the lower or upper groove during downstroke or upstroke, respectively. During upstroke, the solids are expelled through the exit ports. A hardened insert may be positioned in the head region, providing a durable wear area for the valve rod as well as a tight fit, thereby preventing solids from escaping through a northern end of the guide.

18 Claims, 10 Drawing Sheets

VALVE ROD GUIDE WITH CYCLONIC DEBRIS REMOVAL

RELATED APPLICATION

This non-provisional application claims priority from provisional application No. 61/110,050, filed on Oct. 31, 2008, in the name of the inventor of this non-provisional application.

FIELD OF THE INVENTION

The present invention relates generally to fluid pumping apparatuses and, more particularly, to guides for valve rods, hollow valve rods, and pull tubes.

BACKGROUND OF THE INVENTION

Oil well pumping systems are well known in the art. Such systems are used to mechanically remove oil or other fluid from beneath the earth's surface, particularly when the natural pressure in an oil well has diminished. As shown in FIG. 22, an oil well pumping system begins with an above-ground pumping unit 102, which may commonly be referred to as a "pumpjack," "nodding donkey," "horsehead pump," "beam pump," "sucker rod pump," and the like. The pumping unit 102 creates a reciprocating (up and down) pumping action that moves the oil (or other substance being pumped) out of the ground 100 and into a flow line, from which the oil is then taken to a storage tank or other such structure.

Below the ground 100, a shaft is lined with piping 104 known as "tubing." Into the tubing 104 is inserted a string of sucker rods 106, which ultimately is indirectly coupled at its north end to the above-ground pumping unit 102. The string of sucker rods 106 is ultimately indirectly coupled at its south end to a subsurface pump 108 that is located at or near the fluid in the oil well. As shown in FIG. 23, the subsurface pump 108 has a number of basic components, including a barrel 110 and a plunger 112. The plunger 112 operates within the barrel 110, and the barrel 110, in turn, is positioned within the tubing 104. It is common for the barrel 110 to include a standing valve 114 and the plunger 112 to include a traveling valve 116. The north end of the plunger 112 is typically connected to a valve rod 118, hollow valve rod 118, or pull tube, which moves up and down to actuate the pump plunger 112. The valve rod 118, hollow valve rod 118, or pull tube passes through a guide 120 positioned at the north end of the barrel 110, which assists in centering the valve rod 118, hollow valve rod 118, or pull tube, and thereby, the plunger 112. In addition, the guide 120 includes openings through which the oil (or other substance being pumped) may exit the pump barrel 110 and travel into the tubing 104.

There are a number of problems that may occur during oil pumping operations. Fluid that is pumped from the ground 100 is generally impure, and includes solid impurities such as sand, pebbles, limestone, and other sediment and debris. Certain kinds of pumped fluids, such as heavy crude, tend to contain a relatively large amount of solids. Because of this, several disadvantages exist with prior art guides 120 for valve rods 118, hollow valve rods 118, and pull tubes. For example, the orientation of the side openings in such prior art guides 120 permits fluid, and any solid impurities entrained therein, to shoot straight out in the direction of the pump barrel 110 when it is expelled from the guide 120. This causes damage to the barrel 110 due to the high velocity of the fluid during pumping operations. Further, after the solids have been exhausted from the pump barrel 110 and the pump 102 has temporarily discontinued pumping operations, the solids will naturally begin to settle due to gravity. With prior art guides 120 for valve rods 118, hollow valve rods 118, and pull tubes, the solids are able to reenter the pump barrel 110 at this time, via the openings in the guide 120. This often results in excessive barrel 110 wear upon restarting of the pump 102. Further, it is possible that with the solids reentering the pump barrel 110, they may cause sticking of the pump 102—i.e., seizing the plunger 112 in the barrel 110.

As another example, solids often cling to valve rods 118, hollow valve rods 118, and pull tubes during pumping operations. Typically, with prior art guides 120 for valve rods 118, hollow valve rods 118, and pull tubes, this can result in the binding or seizing of the guide 120 to the valve rod 118, hollow valve rod 118, or pull tube that is moving up and down actuating the pump plunger 112. This seizing can cause the pump 102 to stop functioning, by preventing the valve rod 118, hollow valve rod 118, or pull tube from being actuated, thereby damaging the sucker rod 106 and guide 120.

As another example, the north ends of prior art guides 120 for valve rods 118, hollow valve rods 118, and pull tubes are frequently subjected to excessive wear and damage by virtue of the sucker rod 106 activity. In this regard, the sucker rod 106 is attached proximate the north end of the valve rod 118, hollow valve rod 118, or pull tube (whichever is being employed). The sucker rod 106 sometimes carries side loads when the pump 102 is in a downward stroke. The side loads can impart excessive wear and damage on the side of the guide 120 for the valve rod 118, hollow valve rod 118, or pull tube, rendering the guide 120 useless.

A need therefore exists for a guide 120 for a valve rod 118, hollow valve rod 118, and pull tube that provides for improved debris removal capability and wear resistance.

The present invention satisfies these needs and provides other, related, advantages.

SUMMARY OF THE INVENTION

In accordance with an embodiment of the present invention, a valve rod guide for a pumping apparatus is disclosed. The valve rod guide comprises, in combination: a base region adapted to be coupled to a barrel of a subsurface pump; a body region positioned above the base region, the body region including a plurality of downwardly tapering flutes, wherein each flute of the plurality flutes includes at least one opening to permit a flow of a pumped substance to pass therethrough; a neck region positioned above the body region, wherein an interior diameter of the neck region includes at least one exit port; a head region positioned above the neck region, wherein the head region is adapted to receive at least one sucker rod; and a longitudinal channel passing through the base, body, neck, and head regions wherein the longitudinal channel is adapted to permit a valve rod to pass therethrough.

In accordance with another embodiment of the present invention, a valve rod guide is disclosed. The valve rod guide comprises, in combination: a base region adapted to be coupled to a barrel of a subsurface pump, wherein the base includes an external threaded section; a body region positioned above the base region, the body region including; a plurality of downwardly tapering radial flutes, wherein each flute of the plurality flutes includes at least one opening to permit a flow of a pumped substance to pass therethrough; and a first shoulder and a second shoulder positioned below the first shoulder, the second shoulder adapted to abut a northern end of the barrel of the subsurface pump; wherein each flute of the plurality of flutes extends from the first shoulder to a position above the second shoulder; a neck region positioned above the body region, wherein an interior diameter of the neck region includes at least one exit port; a head region positioned above the neck region, wherein the head region is adapted to receive at least one sucker rod; a substantially ring-shaped insert adapted to fit within an interior diameter of the head region; and a longitudinal channel passing through the base, body, neck, and head regions and adapted to permit a valve rod to pass therethrough.

In accordance with a further embodiment of the present invention, a method for directing fluid through a valve rod guide is disclosed. The method comprises the steps of: providing a valve rod guide for a pumping apparatus comprising, in combination: a base region adapted to be coupled to a barrel of a subsurface pump, wherein the base includes an external threaded section; a body region positioned above the base region, the body region including: a plurality of downwardly tapering radial flutes, wherein each flute of the plurality flutes includes at least one opening to permit a flow of a pumped substance to pass therethrough; and a first shoulder and a second shoulder positioned below the first shoulder, the second shoulder adapted to abut a northern end of the barrel of the subsurface pump; wherein each flute of the plurality of flutes extends from the first shoulder to a position above the second shoulder; a neck region positioned above the body region, wherein an interior diameter of the neck region includes at least one exit port; a head region positioned above the neck region, wherein the head region is adapted to receive at least one sucker rod; a substantially ring-shaped insert adapted to fit within an interior diameter of the head region; and a longitudinal channel passing through the base, body, neck, and head regions and adapted to permit a valve rod to pass therethrough; pumping the fluid northward through the valve rod guide by causing the fluid to enter the base region, to then enter the body region, to then enter the neck region, to then exit the valve rod guide, wherein the fluid has solid impurities entrained therein.

DETAILED DESCRIPTION OF THE PREFERRED EMBODIMENTS

Figure 1:
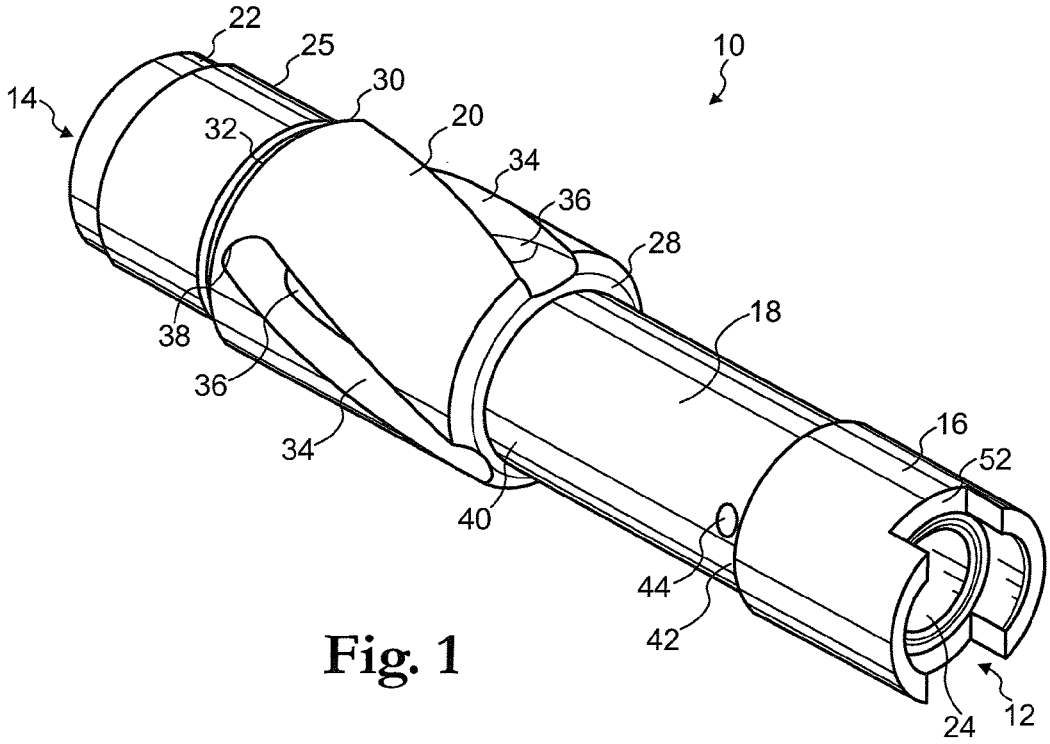
FIG. 1 is a perspective view of a valve rod guide device, consistent with an embodiment of the present invention.
Figure 2:
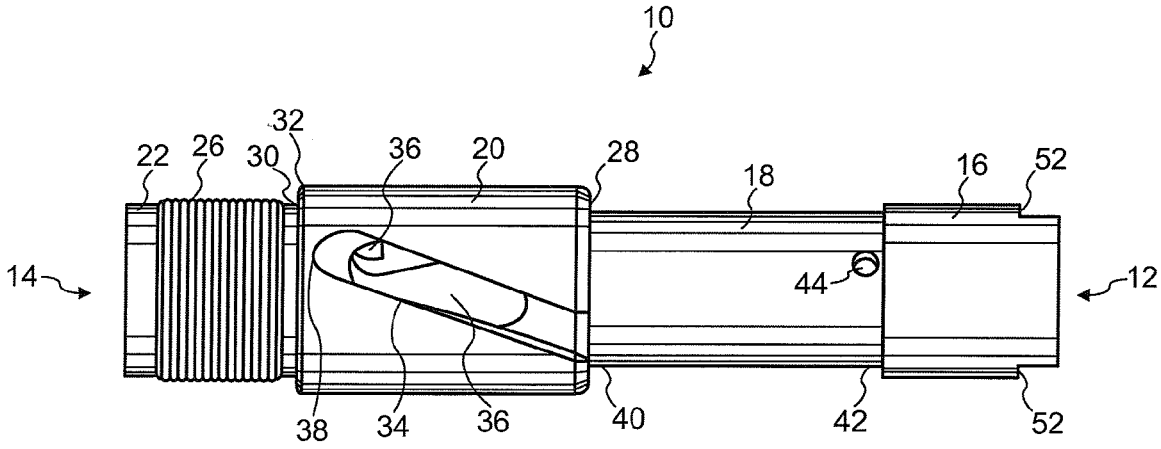
FIG. 2 is a side view of the valve rod guide device of FIG. 1 with a sleeve portion thereof removed to reveal threading on the valve rod guide device.

Referring first to FIGS. 1 and 2, a valve rod guide device 10 ("valve rod guide 10") consistent with an embodiment of the present invention is shown. (While in the detailed description herein the term "valve rod guide" is used throughout, it should be understood that the guide of the present invention may also be employed with a hollow valve rod or a pull tube, without departing from the spirit or scope of the invention.) The valve rod guide 10 includes a north end 12 and a south end 14. In this embodiment, the valve rod guide 10 generally comprises a one-piece structure having the following main components: a head region 16, a neck region 18, a body region 20, and a base region 22. The valve rod guide 10 is substantially tubular, having a longitudinal channel 24 running therethrough (as seen in FIG. 1, for example). The valve rod guide 10 may be composed of a hardened material, such as carbide, an alloy or some other suitable material.

Figure 15:
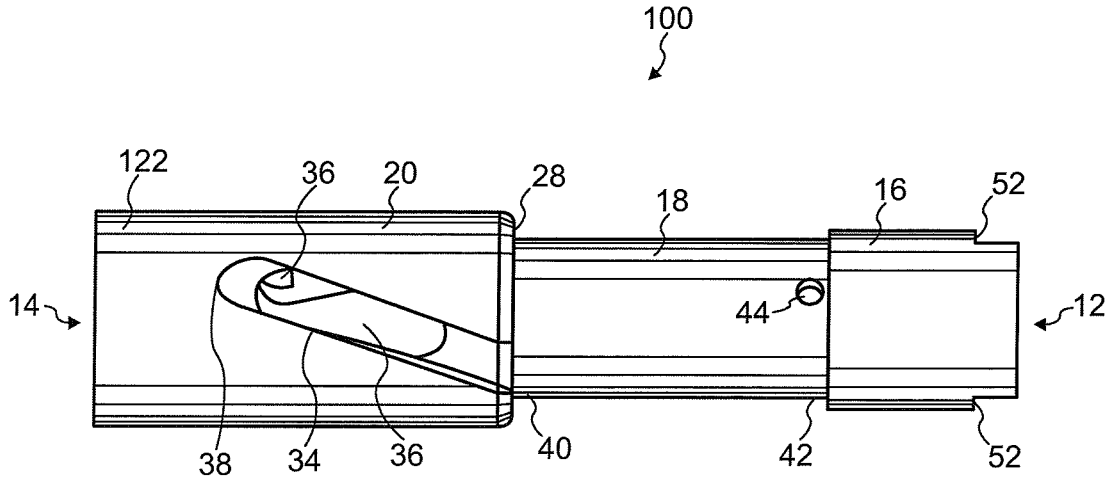
FIG. 15 is a side view of a valve rod guide device, consistent with an embodiment of the present invention.
Figure 16:
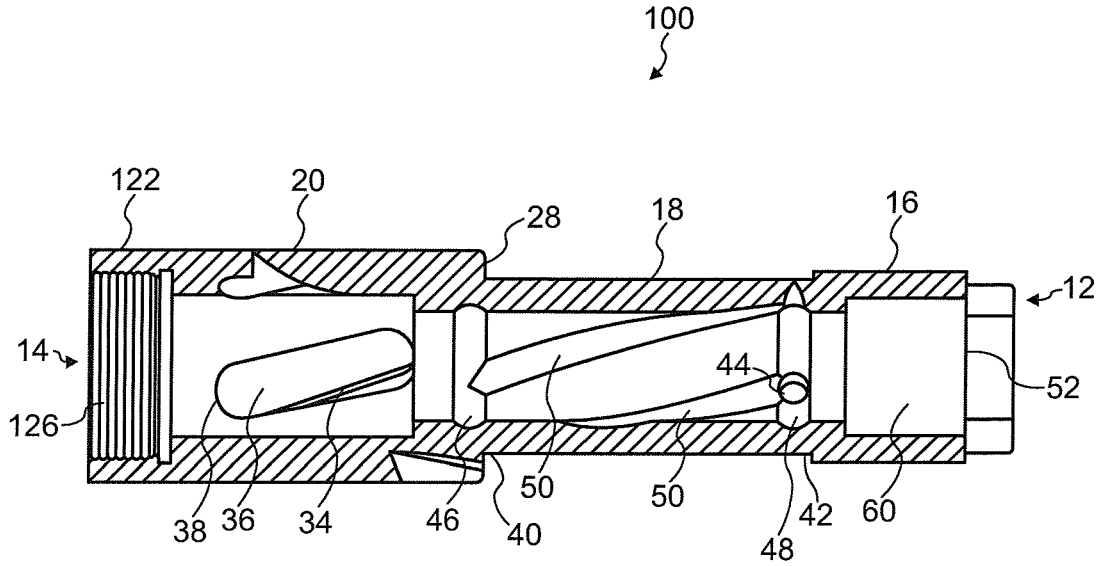
FIG. 16 is a side, cut-away view of the valve rod guide device of FIG. 15.

Turning first to the base region 22, as shown in this embodiment, and as seen in FIG. 2, the base region 22 includes male threading 26, such that it may be coupled to a northern end of a barrel of a subsurface pump or the like (not shown). This configuration permits the base region 22 of the valve rod guide 10 to be screwed directly into a pump barrel, without the need for any connector components. Referring to FIG. 1, a sleeve 25 may be positioned around the threading 26 of the base region 22 when the valve rod guide 10 is not coupled to a subsurface pump. While the base region 22 is shown as a male component in this embodiment of the valve rod guide 10, it should be clearly understood that substantial benefit could be derived from an alternate configuration of the base region 22 in which a female threaded component is employed, without departing from the spirit or scope of the present invention. An example of such an alternate configuration is shown in FIGS. 15 and 16 and is discussed further below.

The body region 20, as shown in this embodiment, includes a first shoulder 28, a second shoulder 30, and a plurality of flutes 34. The first shoulder 28 may be rounded, as shown in this embodiment. The second shoulder 30, as shown in this embodiment, may be substantially squared-off. When the valve rod guide 10 is coupled to the barrel of a subsurface pump or the like (not shown), the second shoulder 30 may be positioned to abut the northern end of the barrel. The second shoulder 30 may include ridge 32. As shown in this embodiment, ridge 32 may be angled downwardly (southwardly).

Figure 6:
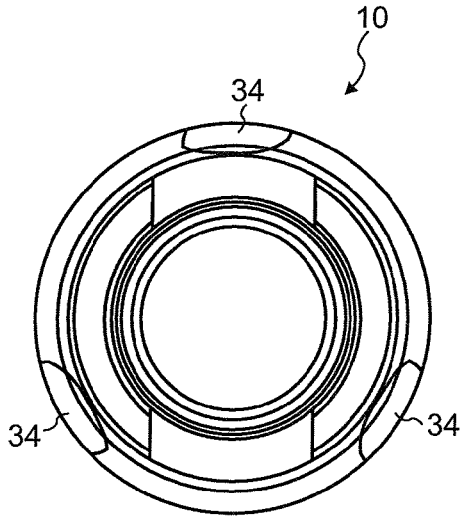
FIG. 6 is a top view of the valve rod guide device of FIG. 1.
Figure 7:
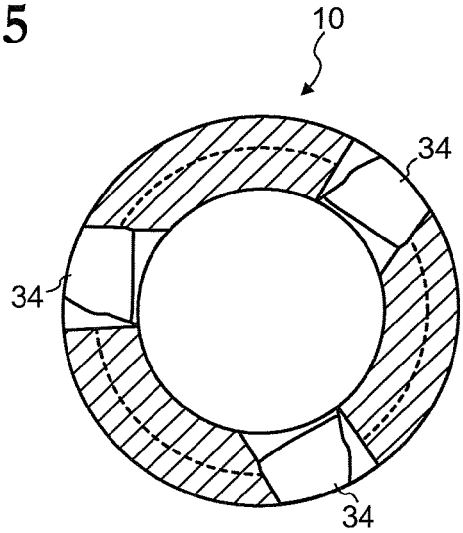
FIG. 7 is a top, cut-away view of a portion of the valve rod guide device of FIG. 1.
Figure 8:
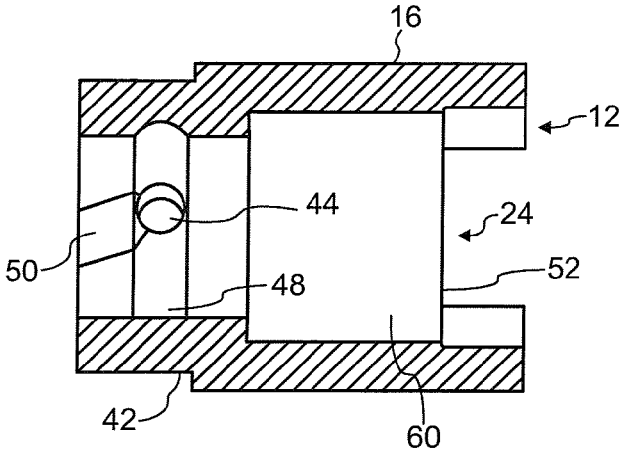
FIG. 8 is a side, cut-away view of a top portion of the valve rod guide device of FIG. 1.

Referring to the flutes 34, in this embodiment, three flutes 34 are included in the valve rod guide 10, as best seen in FIGS. 6 and 7. However, it may be desired to configure a valve rod guide 10 having more than three or less than three flutes 34. In one embodiment, the flutes 34 may be radial and oriented on an upward (northward) angle. (In one embodiment, for example, the flutes 34 may be oriented on an upward (northward) angle of at least 45 degrees from horizontal.) Such an orientation of the flutes 34 imparts a cyclonic rotation on fluids and solids as they are exhausted from the flutes 34. (This also helps to direct the flow of fluid northward as it flows through openings 36, as mentioned below.) In this way, the flutes 34 may assist in facilitating the rotation of fluid with solids and enable the solids to be suspended in an orbital rotation for a longer duration during pumping operations, compared with prior art valve rod guides. This helps to eliminate rod stress, particularly on the upstroke, as caused by solid impurities that would otherwise cling to the rod, as is a common occurrence with typical prior art valve rod guides. The flutes 34, as seen in this embodiment, extend from the first shoulder 28 to a position 38 above (northward of) the second shoulder 30. The flutes 34 include openings 36, through which fluids and solids may be exhausted during pumping operations. The openings 36 are substantially elongated, but may be configured in other ways, as desired. Preferably, the flutes 34 taper downwardly (southwardly) proximate position 38. In this embodiment, the flutes 34 are spaced equidistant from each other, but could be spaced apart in other configurations.

The downward (southward) tapering of the flutes 34 proximate position 38, as discussed above, may provide one or more advantages. For example, this design assists in preventing solids that have been exhausted from the pump barrel through the flutes 34 from reentering the pump barrel. This is a problem with standard prior art valve rod guides, as solids often reenter the pump barrel by way of the valve rod guide. This occurs after pumping operations have stopped and the solids have begun to settle due to gravity. When solids settle back into the pump barrel and the pump is restarted, excessive barrel wear can result, as well as sticking the pump—i.e., seizing the plunger in the barrel. Accordingly, by preventing the reentry of solids into the pump barrel, the operating life of the pump and its components may be extended.

The neck region 18 includes a lower portion 40, an upper portion 42, and a plurality of exit ports 44. In this embodiment, the exit ports 44 are spaced equidistant from each other, but could be spaced apart in other configurations. In one embodiment, for example, three exit ports 44 may be employed. However, it may be desired to configure a valve rod guide 10 having more than three or fewer than two exit ports 44. In one embodiment, the exit ports 44 may be oriented on an upward (northward) angle. (For example, it may be desired for the exit ports 44 to be oriented on an upward angle corresponding to the upward angle orientation of the flutes 34, as mentioned above.) In this way, the exit ports 44 will direct the flow of solids and fluids northward as they are exhausted through the exit ports 44.

Figure 3:
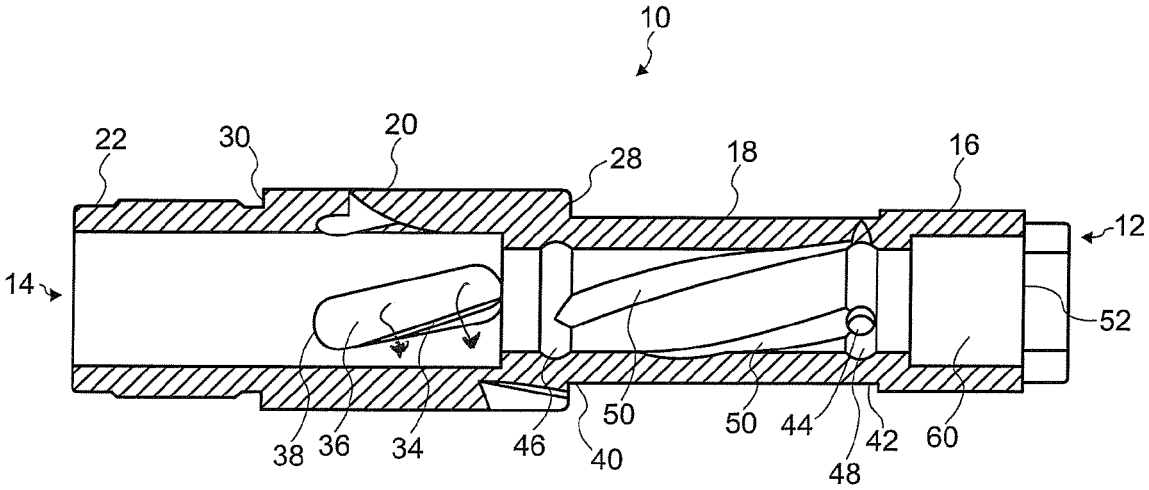
FIG. 3 is a side, cut-away view of the valve rod guide device of FIG. 1.
Figure 4:
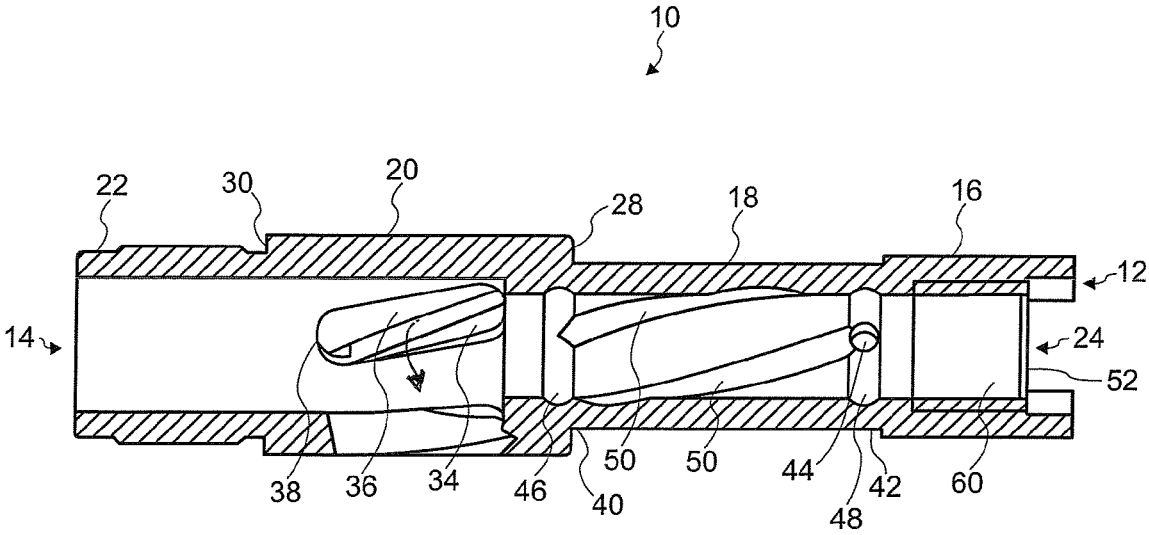
FIG. 4 is another side, cut-away view of the valve rod guide device of FIG. 1.
Figure 5:
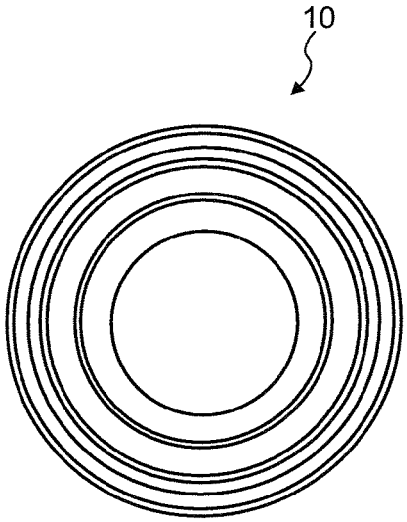
FIG. 5 is a bottom view of the valve rod guide device of FIG. 1.

Turning now to FIGS. 3 and 4 and referring specifically to the interior diameter of the neck region 18, it includes a lower groove 46, an upper groove 48, and a plurality of spiral radial flutes 50. The lower groove 46 and upper groove 48 are substantially ring-shaped, following the interior diameter of the neck region 18. In one embodiment, the lower groove 46 and upper groove 48 may each be 360 degrees. Each spiral radial flute 50 extends from the lower groove 46 to the upper groove 48, terminating at one of the exit ports 44. In one embodiment, three spiral radial flutes 50 are employed with the valve rod guide 10, but it may be desired to configure a valve rod guide 10 having more than three or fewer than three spiral radial flutes 50.

The design of the spiral radial flutes 50 and their extension from the lower groove 46 to the upper groove 48, as discussed in the preceding paragraph, may provide one or more advantages. For example, during pumping operations, this design facilitates the wiping of solids from the valve rod as the valve rod travels through the channel 24 of the valve rod guide 10. This allows for the accumulation of such solids into a common area. In this regard, on a downstroke, the solids are wiped from the valve rod and dragged into the spiral radial grooves 50, to be moved downwardly through the spiral radial grooves 50 and to accumulate in the lower groove 46. On an upstroke, the solids are wiped from the valve rod and dragged into the spiral radial grooves 50, to be moved upwardly through the spiral radial grooves 50 and then expelled through the exit ports 44 as a result of friction between the solids and the valve rod that drags the solids toward the exit ports 44. Once the solids have arrived at the exit ports 44, they are prevented from traveling further upward (northward) within the channel 24 of the valve rod guide 10, due to a tight fitting at the top of the valve rod guide 10, as further discussed below. The solids thus accumulate in the area of the upper groove 48, and are then forced out of the exit ports 44 by way of the energy produced by the travel of the valve rod. This keeps the valve rod guide 10 from binding or seizing to the valve rod. Such seizing would cause the pump to stop functioning by preventing the valve rod from being actuated, and could cause damage to the sucker rod and valve rod guide as a result.

Figure 13:
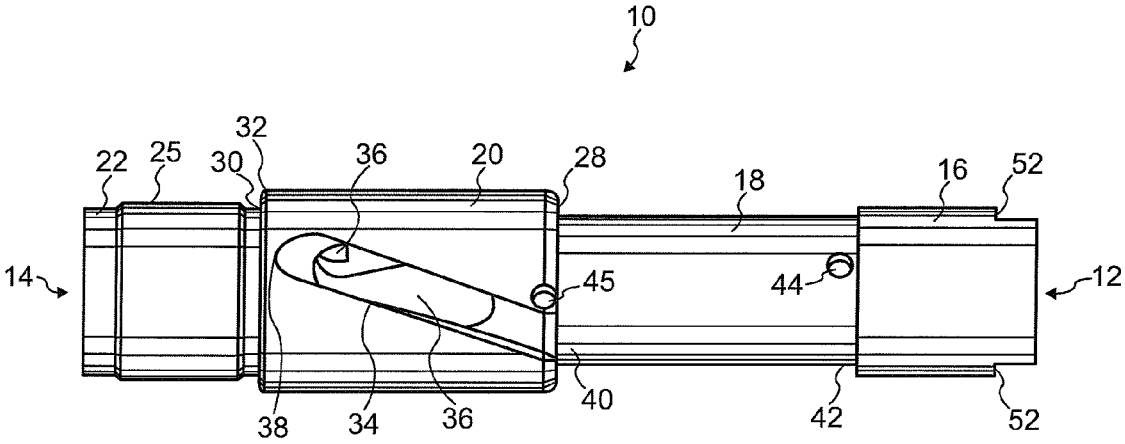
FIG. 13 is a side view of a valve rod guide device, consistent with an embodiment of the present invention.
Figure 14:
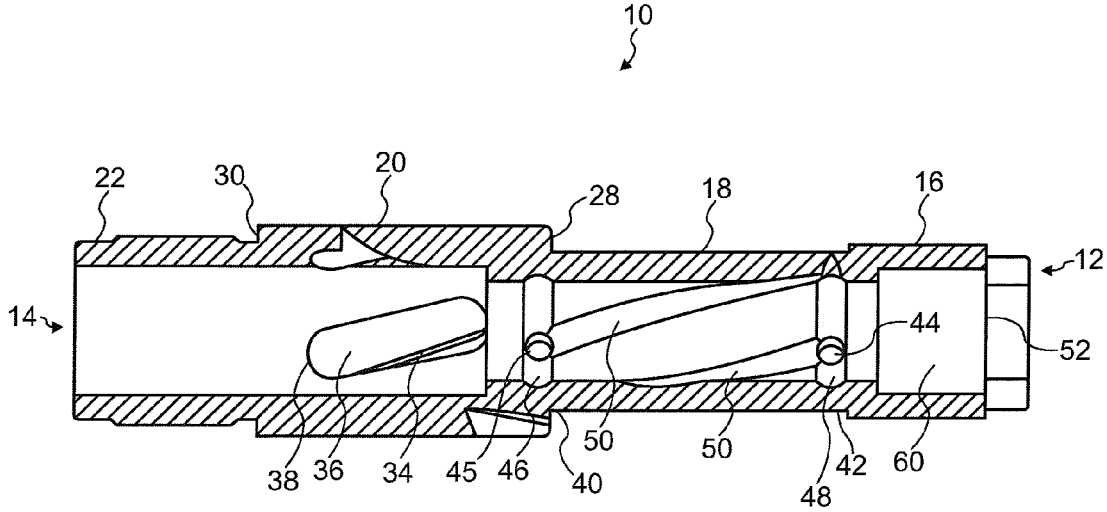
FIG. 14 is a side, cut-away view of the valve rod guide device of FIG. 13.

While this embodiment illustrates exit ports 44 positioned proximate the upper groove 48, it may be desired to also include another set of exit ports ("exit ports 45"), as shown in FIGS. 13 and 14. Referring to FIGS. 13 and 14, in one embodiment of the valve rod guide 10, exit ports 45 are positioned proximate the lower groove 46. In this embodiment, preferably two or more exit ports 45 are employed. In one embodiment, for example, three exit ports 45 may be employed. However, it may be desired to configure a valve rod guide 10 having more than three or fewer than two exit ports 45. Having exit ports 45 in addition to exit ports 44, the embodiment of the valve rod guide 10 shown in FIGS. 13 and 14 thus permits solids to be discharged through lower exit ports 45 following a downstroke, in addition to discharging solids through exit ports 44 following an upstroke. Such a configuration may be desired, in particular, in extreme conditions where high volumes of solids may be present. As with the exit ports 44, in one embodiment, the exit ports 45 may be oriented on an upward (northward) angle, (For example, it may be desired for the exit ports 45 to be oriented on an upward angle corresponding to the upward angle orientation of the flutes 34, as mentioned above.) In this way, the exit ports 45 will direct the flow of solids and fluids northward as they are exhausted through the exit ports 45.

Figure 9:
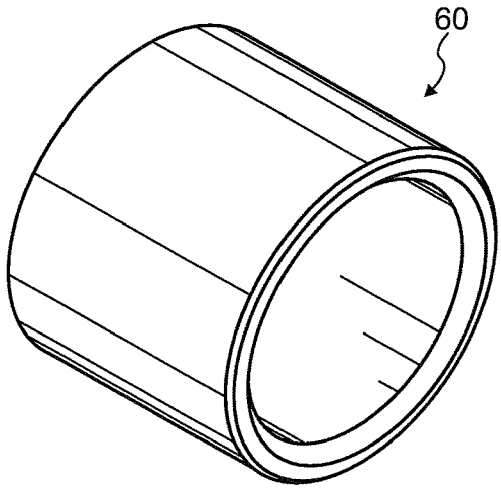
FIG. 9 is a perspective view of an insert device portion of a valve rod guide device, consistent with an embodiment of the present invention.
Figure 10:
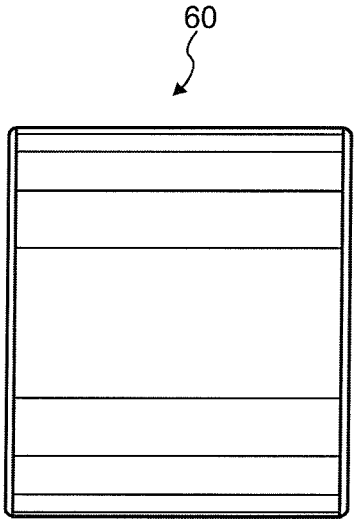
FIG. 10 is a side view of the insert device of FIG. 9.
Figure 11:
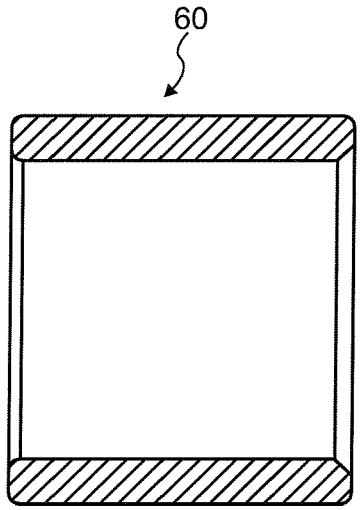
FIG. 11 is a side, cut-away view of the insert device of FIG. 9.
Figure 12:
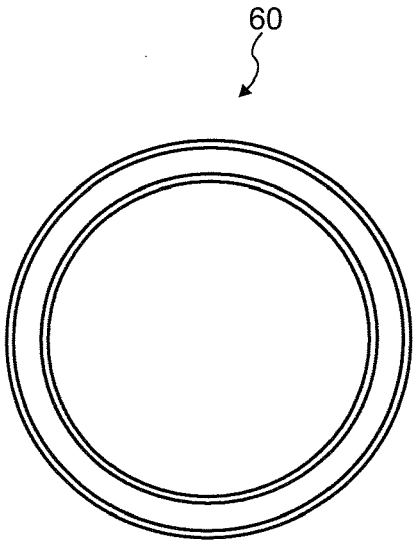
FIG. 12 is a top view of the insert device of FIG. 9.

Referring again to FIGS. 1 and 2, the head region 16 of the valve rod guide 10 includes a notched-out portion 52, to facilitate the attachment of sucker rods. Referring to FIGS. 3 and 4, the head region 16 preferably includes an insert 60. An embodiment of the insert 60 may be seen in close-up detail in FIGS. 9-12. As shown particularly in the embodiment in FIGS. 9 and 12, the insert 60 comprises a ring-shaped device. The insert 60 is adapted to fit within the interior diameter of the head region 16 of the valve rod guide 10, as illustrated in FIGS. 3 and 4. In one embodiment, the insert 60 may be composed of a hardened material, such as carbide, an alloy, or some other suitable hardened material. In another embodiment, the insert 60 may be coated with a material such as carbide, nickel, an alloy, or the like. By virtue of the insert 60, the valve rod is provided with a stronger wear area. This is important because sucker rods sometimes carry a side load during a downstroke. Such a side load has a tendency to erode and damage the sides of typical valve rod guides, eventually rendering them useless. The insert 60 helps to prevent this from occurring, thereby allowing for a longer life for the valve rod guide 10, compared with standard prior art valve rod guides. The insert 60 may also provide for a tight fitting for the valve rod. In this regard, in one embodiment, the interior diameter of the head region 16, with the insert 60 positioned therein, may be such that when the valve rod is positioned therethrough, there is a minimal amount of space between the insert 60 and the valve rod, in the range of 0.005 to 0.010 inches, for example.

Figure 19:
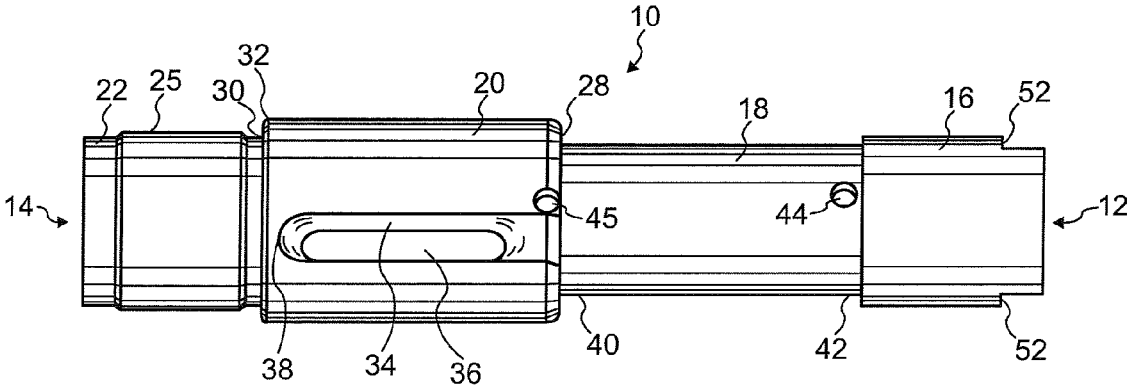
FIG. 19 is a side view of a valve rod guide device, consistent with an embodiment of the present invention.
Figure 20:
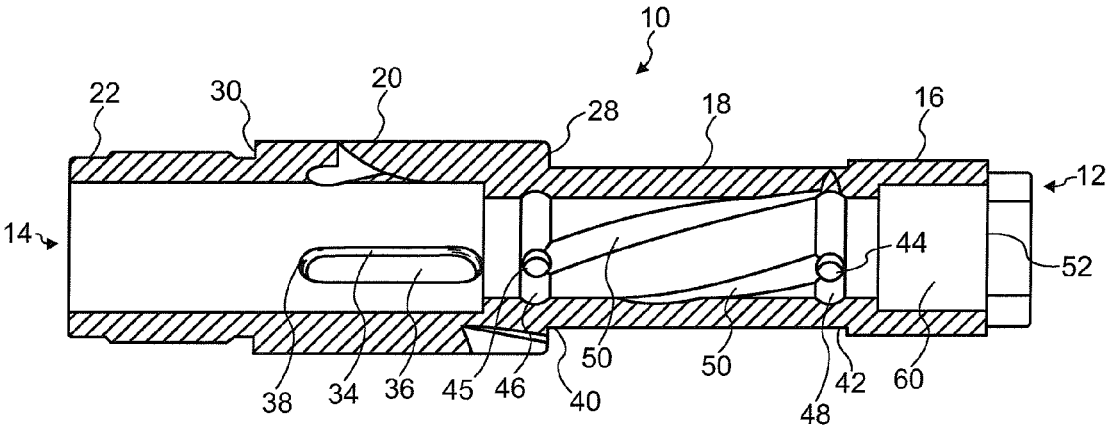
FIG. 20 is a side, cut-away view of the valve rod guide device of FIG. 19.
Figure 21:
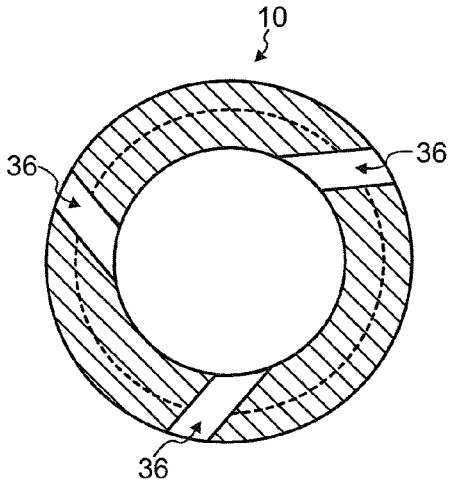
FIG. 21 is a top, cut-away view of the valve rod guide device of FIG. 19.
Figure 22:
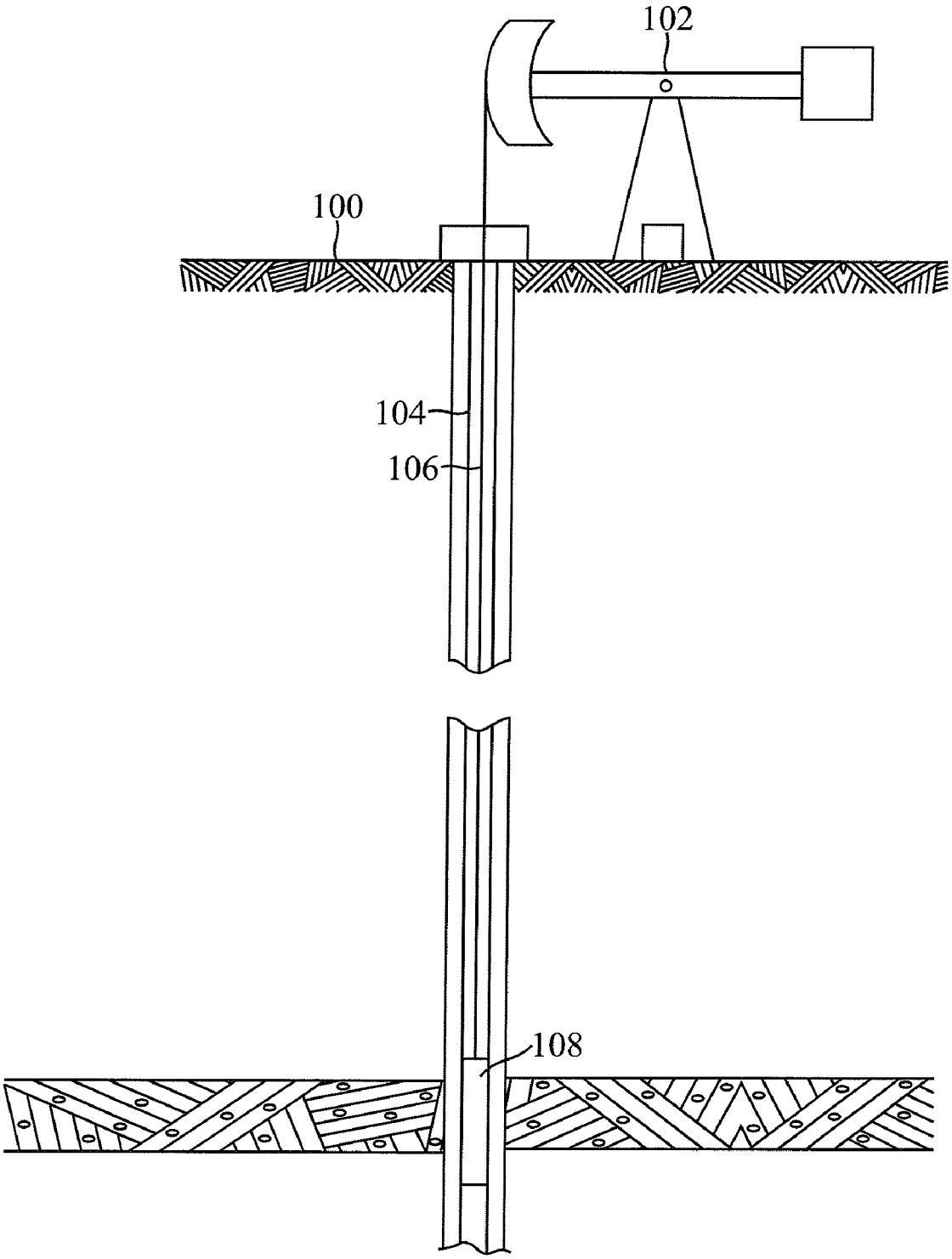
Fig. 22 (PRIOR ART)
FIG. 22 is a schematic diagram of a well, shown with pumping equipment.
Figure 23:
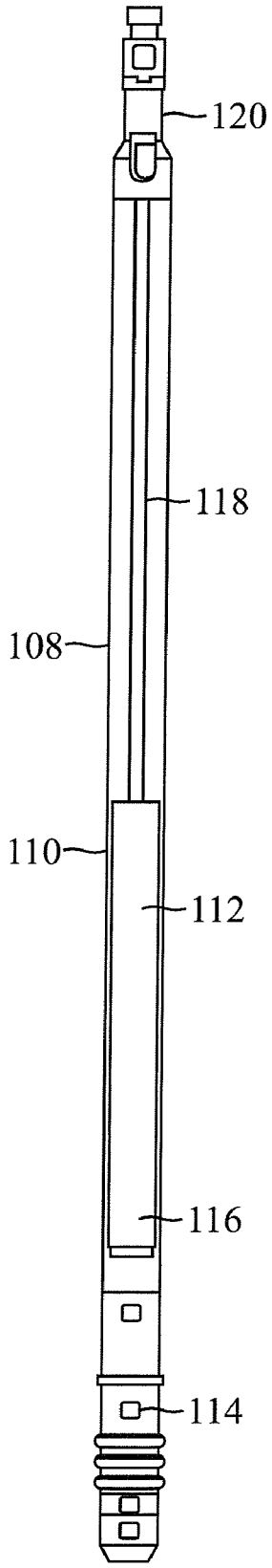
Fig. 23 (PRIOR ART)
FIG. 23 is a side view of a prior art pump, shown partially broken away.

Referring now to FIGS. 19-21, in one embodiment of the valve rod guide 10, the flutes 34 may be configured in a north-south orientation instead of a radial orientation. In this embodiment, the flutes 34 preferably angle inwardly, as best seen in FIG. 21, such that openings 36 on the flutes 34 are offset from a center of the interior diameter of the valve rod guide 10. Such an orientation of the flutes 34 imparts a cyclonic rotation on fluids and solids as they are exhausted from the flutes 34. In this way, the flutes 34 may assist in facilitating the rotation of fluid with solids and enable the solids to be suspended in an orbital rotation for a longer duration during pumping operations, compared with prior art valve rod guides. This helps to eliminate rod stress on the upstroke, as caused by solid impurities that would otherwise cling to the rod, as is a common occurrence with typical prior art valve rod guides. The flutes 34, as seen in this embodiment, extend from the first shoulder 28 to a position 38 north of the base region 22. The openings 36 on the flutes 34 are substantially elongated, but may be configured in other ways, as desired. In this embodiment, the flutes 34 are spaced equidistant from each other, but could be spaced apart in other configurations.

Referring now to FIGS. 15 and 16, an alternative embodiment of a valve rod guide device 10 (hereinafter "valve rod guide 100"), consistent with an embodiment of the present invention is shown. The valve rod guide 100 is substantially the same as the valve rod guide 10, except that it is configured as a female component, while the valve rod guide 10 is configured as a male component. The valve rod guide 100 includes a base region 122 and female threading 126, which differ from the base region 22 and male threading 26, respectively, of the valve rod guide 10. With respect to the base region 122 of the valve rod guide 100, as shown in this embodiment, and as seen in FIG. 16, the base region 122 includes female threading 126. The female threading 126 is adapted to be coupled to a connector piece (not shown). When a connector piece (not shown) is utilized with this embodiment, the valve rod guide 100 may then be coupled to a northern end of a barrel of a subsurface pump or the like (not shown). The valve rod guide 100 is similar in all other respects to the valve rod guide 10 described in the foregoing paragraphs.

Figure 17:
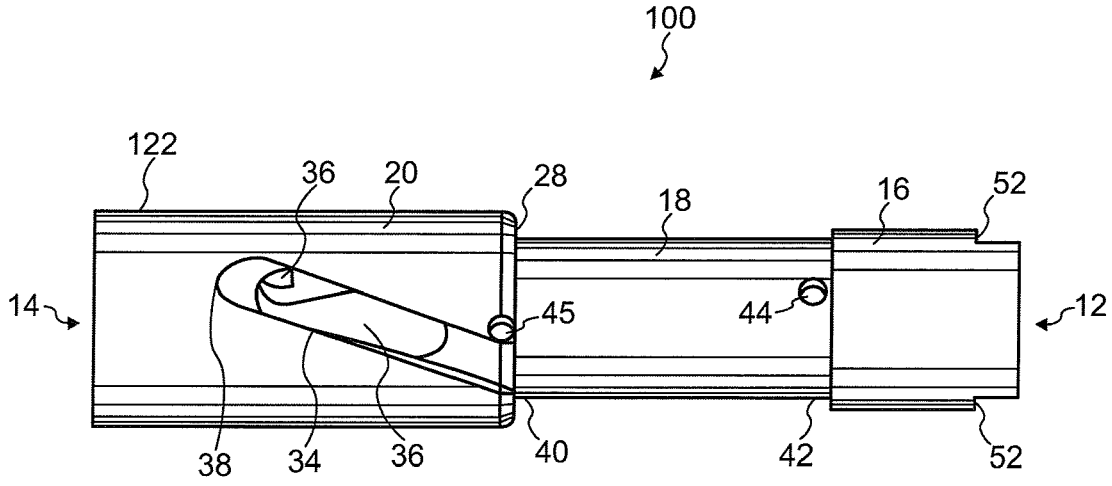
FIG. 17 is a side view of a valve rod guide device, consistent with an embodiment of the present invention.
Figure 18:
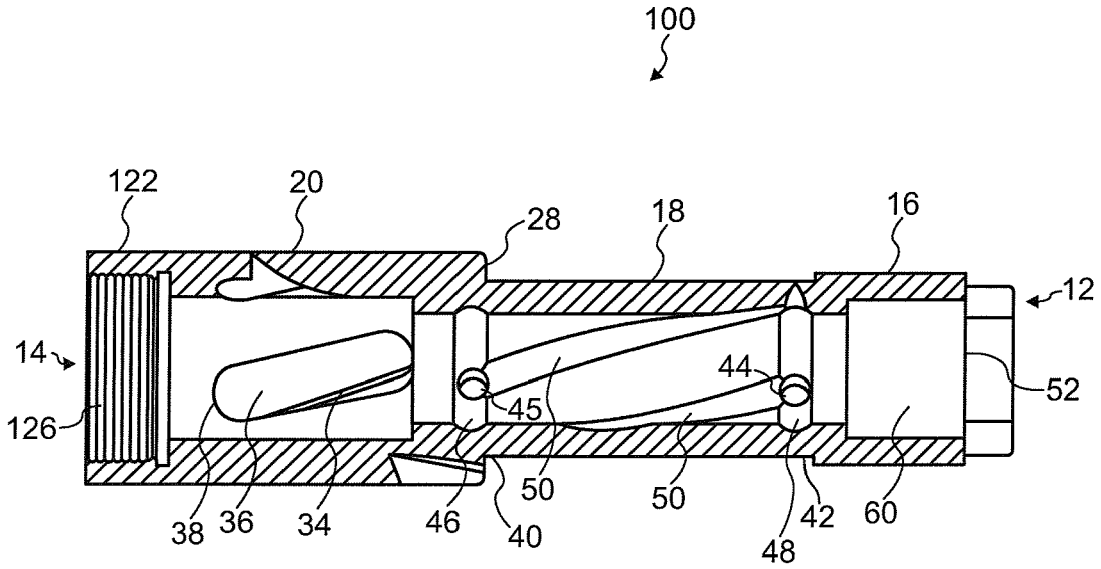
FIG. 18 is a side, cut-away view of the valve rod guide device of FIG. 17.

While the embodiment of the valve rod guide 100 shown in FIGS. 15 and 16 illustrates exit ports 44 positioned proximate the upper groove 48, it may be desired to also include another set of exit ports ("exit ports 45"), as shown in FIGS. 17 and 18. (With respect to the exit ports 44, as with the valve rod guide 10, preferably, two or more exit ports 44 are employed. In one embodiment, for example, three exit ports 44 may be employed. However, it may be desired to configure a valve rod guide 100 having more than three or fewer than two exit ports 44.) Referring to FIGS. 17 and 18, in one embodiment of the valve rod guide 100, exit ports 45 are positioned proximate the lower groove 46. The exit ports 45 shown in this embodiment provide the same advantages and benefits as discussed above with respect to the valve rod guide 10. As with the valve rod guide 10, preferably two or more exit ports 45 are employed. In one embodiment, for example, three exit ports 45 may be employed. However, it may be desired to configure a valve rod guide 100 having more than three or fewer than two exit ports 45.

While the invention has been particularly shown and described with reference to the preferred embodiments thereof, it will be understood by those skilled in the art that the foregoing and other changes in form and details may be made therein without departing from the spirit and scope of the invention.

I claim:

1. A valve rod guide for a pumping apparatus comprising, in combination:

a base region adapted to be coupled to a barrel of a subsurface pump driven by a valve rod connected to at least one sucker rod;

a body region positioned above the base region, the body region including a plurality of downwardly tapering flutes, wherein each flute of the plurality of downwardly tapering flutes includes at least one opening to permit a flow of a pumped substance to pass therethrough and radially extends at an acute upward angle along an exterior of the body region;

a neck region positioned above the body region, wherein an interior diameter of the neck region includes at least one exit port; where a plurality of spiral radial flutes are formed on an interior cylindrical surface corresponding to the interior diameter of the neck region, and terminate at the at least one exit port;

a head region positioned above the neck region, wherein the head region is adapted to receive the at least one sucker rod; and a longitudinal channel passing through the base, the body, the neck, and the head regions wherein the longitudinal channel is adapted to permit the valve rod to pass therethrough.

2. The valve rod guide of claim 1, further comprising a threaded region around an external portion of the base region.

3. The valve rod guide of claim 1, wherein the body region further includes a first shoulder and a second shoulder positioned below the first shoulder, the second shoulder adapted to abut a northern end of the barrel of the subsurface pump.

4. The valve rod guide of claim 3, wherein each flute of the plurality of downwardly tapering flutes extends from the first shoulder to a position above the second shoulder.

5. The valve rod guide of claim 1, wherein the neck region includes at least two exit ports.

6. The valve rod guide of claim 1, further comprising a substantially ring-shaped insert adapted to fit within an interior diameter of the head region.

7. The valve rod guide of claim 6, wherein the substantially ring-shaped insert is composed of one of carbide or an alloy.

8. The valve rod guide of claim 1, wherein each flute of the plurality of downwardly tapering flutes radially extends at an upward angle of at least 45° from horizontal.

9. The valve rod guide of claim 1, further comprising:

a lower groove formed in an interior of the neck region; and an upper groove formed in the interior of the neck region;

wherein each of the plurality of spiral radial flutes extends from the lower grove to the upper groove.

10. A valve rod guide for a pumping apparatus comprising, in combination:

a base region adapted to be coupled to a barrel of a subsurface pump driven by a valve rod connected to at least one sucker rod, wherein the base includes an external threaded section;

a body region positioned above the base region, the body region including:

a plurality of downwardly tapering radial flutes, wherein each flute of the plurality of downwardly tapering flutes includes at least one opening to permit a flow of a pumped substance to pass therethrough, the plurality of downwardly tapering flutes radially extending at an acute upward angle along an exterior of the body region;

a first shoulder; and a second shoulder positioned below the first shoulder, the second shoulder adapted to abut a northern end of the barrel of the subsurface pump;

wherein each flute of the plurality of downwardly tapering flutes extends from the first shoulder to a position above the second shoulder;

a neck region positioned above the body region, wherein an interior diameter of the neck region includes at least one exit port; and where a plurality of spiral radial flutes are formed on an interior cylindrical surface corresponding to the interior diameter of the neck region, and terminate at the at least one exit port;

a head region positioned above the neck region, wherein the head region is adapted to receive the at least one sucker rod;

a substantially ring-shaped insert adapted to fit within an interior diameter of the head region; and a longitudinal channel passing through the base, the body, the neck, and the head regions and adapted to permit the valve rod to pass therethrough.

11. The valve rod guide of claim 10, wherein the body region includes three flutes.

12. The valve guide of claim 10, wherein the neck region includes at least two exit ports.

13. The valve rod guide of claim 10, wherein the substantially ring-shaped insert is composed of one of carbide or an alloy.

14. The valve rod guide of claim 10, wherein the substantially ring-shaped insert includes an external coating.

15. The valve rod guide of claim 10, wherein each flute of the plurality of downwardly tapering flutes radially extends at an upward angle of at least 45° from horizontal.

16. A method for directing fluid through a valve rod guide comprising the steps of:

providing a valve rod guide for a pumping apparatus comprising, in combination:

a base region adapted to be coupled to a barrel of a subsurface pump driven by a valve rod connected to at least one sucker rod, wherein the base region includes an external threaded section;

a body region positioned above the base region, the body region including:

a plurality of downwardly tapering helical flutes, wherein each flute of the plurality of downwardly tapering helical flutes includes at least one opening to permit a flow of a pumped substance to pass therethrough, the plurality of downwardly tapering helical flutes radially extending along an exterior of the body region;

a first shoulder;

a second shoulder positioned below the first shoulder, the second shoulder adapted to abut a northern end of the barrel of the subsurface pump;

wherein each flute of the plurality of downwardly tapering helical flutes extends from the first shoulder to a position above the second shoulder;

a neck region positioned above the body region, wherein an interior diameter of the neck region includes at least one exit port;

a head region positioned above the neck region, wherein the head region is adapted to receive the at least one sucker rod;

a substantially ring-shaped insert adapted to fit within an interior diameter of the head region; and a longitudinal channel passing through the base, the body, the neck, and the head regions and adapted to permit the valve rod to pass therethrough; and pumping the fluid northward through the valve rod guide by causing the fluid to enter the base region, to then enter the body region, to then enter the neck region, to then exit the valve rod guide through the at least one exit port, wherein the fluid forced out the at least one exit port has solid impurities entrained therein; and further comprising the step of causing a portion of the fluid to enter a lower groove positioned in a lower portion of the neck region, to then exit the valve rod guide through the at least one exit port.

17. The method of claim 16, further comprising the step of causing a portion of the fluid to exit the valve rod guide through the at least one opening in each downwardly tapering radial flute of the plurality of downwardly tapering radial flutes.

18. The method of claim 16, further comprising the step of causing a portion of the fluid to enter at least one spiral radial groove positioned in a portion of the neck region that is north of the lower portion of the neck region, to then exit the valve rod guide through the at least one exit port.

* * * * *